United States Patent [19]

Gavin

[11] 4,371,727

[45] Feb. 1, 1983

[54] FUEL OILS FROM COAL

[75] Inventor: Derek G. Gavin, Longhope, England

[73] Assignee: Coal Industry (Patents) Limited, London, England

[21] Appl. No.: 194,798

[22] Filed: Oct. 7, 1980

[30] Foreign Application Priority Data

Oct. 19, 1979 [GB] United Kingdom ..... 7936411

[51] Int. Cl.[3] ..... C10L 1/08

[52] U.S. Cl. ..... 585/14; 585/276; 585/277; 208/143; 208/144; 208/8 LE; 208/10; 44/1 B; 44/1 R

[58] Field of Search ..... 585/14, 276, 277; 208/143, 144; 44/1 B, 1 R; 208/8 LE, 10

[56] References Cited

U.S. PATENT DOCUMENTS

| | | | |
|---|---|---|---|
| 2,180,206 | 11/1939 | Honnef | 208/10 |
| 3,755,137 | 8/1973 | Schuman | 208/143 |
| 4,094,766 | 6/1978 | Gorin | 208/10 |

FOREIGN PATENT DOCUMENTS

| | | |
|---|---|---|
| 372783 | 5/1932 | United Kingdom . |
| 484127 | 7/1937 | United Kingdom . |
| 493470 | of 0000 | United Kingdom . |
| 730030 | 5/1955 | United Kingdom . |
| 1452610 | of 0000 | United Kingdom . |
| 1546808 | of 0000 | United Kingdom . |
| 1550909 | of 0000 | United Kingdom . |
| 2014186 | 8/1979 | United Kingdom . |

*Primary Examiner*—Jacqueline V. Howard

*Attorney, Agent, or Firm*—Stevens, Davis, Miller & Mosher

[57] ABSTRACT

Fuel oils especially suitable as gas oils for fuelling high speed Diesel engines, are made by hydrogenating a middle oil derived from coal and containing at least 90% of polycyclic hydrocarbons and essentially no paraffinic material, and fractionating the hydrogenated oil to yield the gas oil. The product oil is fully competitive with gas oils from petroleum, and may be blended with petroleum gas oil.

5 Claims, 1 Drawing Figure

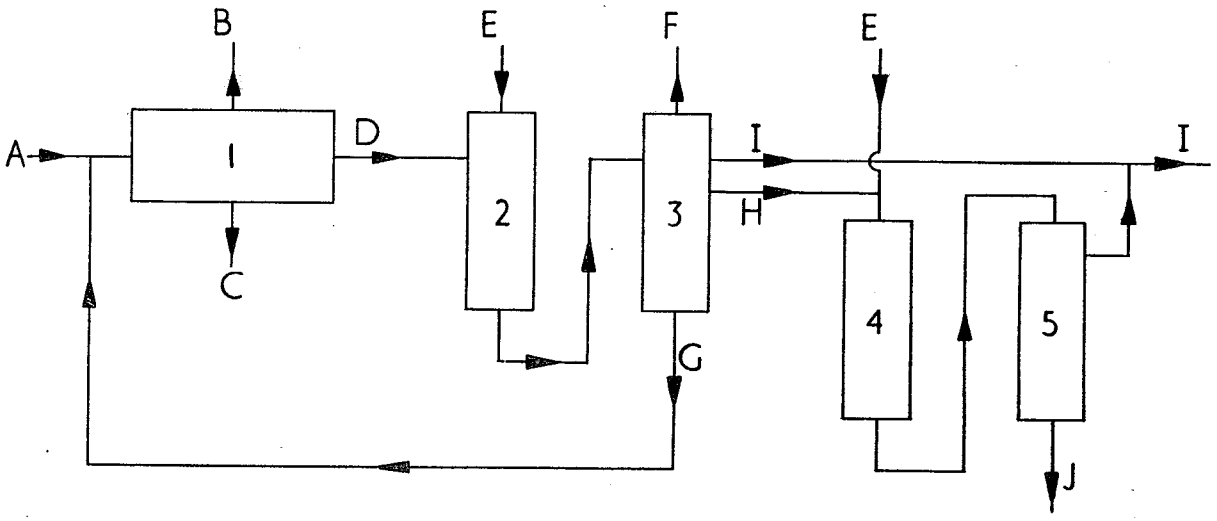
A
B
1
C
D
E
2
F
3
G
I
H
E
4
I
5
J

FUEL OILS FROM COAL

This invention concerns a process for the manufacture of valuable Diesel fuels from coal-derived feedstocks, and a method of fuelling a diesel engine using a coal-derived fuel.

Diesel fuels are currently manufactured from petroleum oils, and are known as gas-oil. Petroleum and its refined products are intermittently subject to shortages for political reasons and it is envisaged that pressure on supplies will further increase in the medium to long term because of limited resources. It is an aim of the present invention to produce Diesel fuels from coal, of which there are substantial reserves in the United Kingdom and certain other countries.

In the period around World War II, there was interest in converting coal to fuel oils. Various processes were proposed, and in British Patent No. 484,127 it was suggested that a middle oil could be produced which could be used as a Diesel oil. In that specification, the starting material is a distillable carbonaceous material which contains asphaltic substances and the primary starting material is tar from the destructive distillation of bituminous or brown coal. Nevertheless, it is suggested, although not illustrated in the Examples, that other starting materials could be obtained by "pressure extraction and/or destructive hydrogenation" of coals. This prior patent specification specifies that the starting material can be freed of asphaltic substances by a mild liquid phase hydrogenation, in which the asphaltic substances are reduced by at least 90% and less than 20% of the material is converted to materials boiling below 350° C. It is suggested that the middle oil fraction of the product may be used as a source of Diesel fuel. All or part of the product may, it is suggested, be treated to gas phase hydrogenation over a catalyst, producing mainly a high octane benzine, plus a middle oil which is said to be a very good Diesel oil. The Examples in which Diesel is said to be produced, hydrogenate tar of which about 50% boils above 350° C., producing a gas oil which is mixed with a gas oil produced by hydrogenating a paraffin wax from the initial hydrogenation. The Diesel (gas) oils produced have cetene numbers of 57 and 68 (equivalent to cetane numbers of 50 and 59.5); other product details are specific gravity of 0.883 and solidifying point of −16° C. We interpret this data to mean that the product Diesel fuel contains a significant proportion of paraffins, for reasons which will be discussed below, and this is the major reason for a high cetane number.

As has been stated, it is believed that the above described process starting from tar leads to gas oils containing significant amounts of paraffins, i.e. straight and branched chain paraffins. One indicator is the presence of paraffin waxes, which are not detected in the case of a starting material from the liquid extraction of coal. Furthermore, high cetane numbers and solidification points of −20° to 0° C. also indicate high proportions of paraffins. Thus it is relatively easy to obtain a Diesel fuel having a high cetane number when the oil contains a high proportion of paraffins. This interpretation is supported by one literature source "Chemistry and Technology of Synthetic Liquid Fuels" I. B. Rapoport, Translated from Russian and published for the National Science Foundation and the Department of the Interior, Washington, 1962. Details are given of gas oils produced by the hydrogenation of brown coal (cetane number=47.8, solidification temp −15° C., density 0.855 [containing 54% alkanes]; after further hydrogenation cetane number=52.4, density=0.837 and solidification temperature=−16.2° C.), and the hydrogenation of middle oil from carbonisation of bituminous coal (aniline point 50°-54° C., 54% alkanes). Tars from carbonisation can be considered as a high quality material, i.e. hydrogen-rich, which are obtained only in low yields, up to 10% by weight of the coal but more usually up to about 5% in coke oven technology. This can be contrasted with coal extracts obtained by the solution of coal in liquid aromatic solvents, in which yields of up to 85% can be obtained, the product being of low quality and having a high proportion of polynuclear aromatics. Coal extracts can thus be considered as an unpromising source of starting material for Diesel fuels.

Another prior proposal to make Diesel fuel from coal was made in British Pat. No. 730,030, which is primarily concerned with the manufacture of gasoline. It is proposed to hydrogenate coal in the liquid phase to gasoline and heavy oil, with only a minor proportion of middle oil. The heavy oil and solid residue is coked to yield more gasoline and middle oil and then a mixture of gasoline and middle oil is hydrogenated in the vapour phase to give an improved gasoline. Although gasoline is the main product, it is said that the process can be operated to produce an excess of middle oil which can be sold for Diesel fuel. The specification does not describe the production of Diesel fuel further. We believe that any middle oil produced in such a process, although boiling in the gas oil range, would be a very poor Diesel fuel indeed, and if useful at all, would be of the lowest grade suitable only for low speed engines of the marine type.

The present invention provides a process for the manufacture of Diesel fuel suitable for high speed engines from coal-derived materials, comprising hydrogenating, over a hydrogenation catalyst, a middle oil which is a fraction of a partially hydrogenated coal oil, which oil contains at least 90% of polycyclic hydrocarbons, contains a major proportion of naphthenes and does not contain any significant amount of mineral matter or paraffinic material, and fractionating the hydrogenated oil to yield a gas oil.

The middle oil derived from coal is preferably a fraction boiling in the range 170° to 350° C. and is preferably the product of hydrocracking coal extract.

A coal extract may be produced by the extraction of coal using a liquid oil or a gaseous solvent under hydrogenative or non-hydrogenative conditions, followed by separation of mineral matter (ash) and undissolved coal. The techniques of extraction by liquid or gaseous solvents are known in the art. The separation of ash and undissolved coal may be carried out in a number of ways but it is believed that filtration and centrifugation are the most practical methods. The coal may be a bituminous or brown coal or lignite. The coal oil may, however, be from a source other than direct coal extraction. It may be an oil product or by-product stream or fraction from a coal conversion process, but it is thought that oil from pyrolysis or hydropyrolysis will contain significant amounts of paraffins.

The catalytic hydrocracking of coal oils has been proposed in the art. Suitable catalysts are those of the type Co or Ni and Mo or W sulphides, or a combination thereof, on a catalyst support which may be γ-alumina, clay, active carbon, zinc oxide, magnesium oxide, aluminosilicates, silica, chromia, etc. A number of hydrocracking catalysts of this type are commercially available. The conditions are preferably selected to yield an oil boiling between 50° and 450° C., with less than 15% by weight boiling above 450°C. It is necessary to fractionate the hydrocracked oil to select a middle oil fraction suitable for further processing. The cut points are preferably within the range 170° to 350° C. and are suitably 180° to 300° C. or 180° to 250° C.

The hydrogenation catalyst may be a metal sulphide from Group VI B or Group VIII B of the Periodic Table, and may be identical to or different from the hydrocracking catalyst mentioned above.

Alternatively, the hydrogenation catalyst may be a supported precious metal catalyst (e.g. Pt, Pd, Rh, Ru) or a supported precious metal sulphide catalyst. Hydrogenation conditions are selected according to the catalyst used, but would generally be within a temperature range of 350° to 450° C. and a hydrogen pressure range of 50 to 750 bar, preferably 180 to 230 bar. Hydrogen concentrations are suitably in the range of 40 to 87%, preferably 85 to 95%, this being dependent upon the source of hydrogen. Liquid hourly space velocities are suitably in the range 0.1 to 8.0 $h^{-1}$, preferably 0.4 to 1.0 $h^{-1}$.

The hydrogenated oil is stripped of the small quantity of lower boiling fractions produced during hydrogenation, by fractionating to remove material boiling below 170° C., preferably removing material boiling below 180° C. The resulting gas oil is useful *inter alia* as a fuel oil for Diesel engines. The upper cut point may be 300° C. or possibly 350° C., the higher cut point in general giving a higher cetane number but also giving a higher density which has a depressant effect on cetane number. The optimum cut points can be determined experimentally.

There are different grades of Diesel fuel, for example as specified in British Standard 2869: 1970 Amended 1977 "Petroleum Fuels for Oil Engines and Burners". In general, grades A1 and A2, having minimum cetane numbers of 50 and 45 respectively, are suitable for high speed engines (e.g. capable of running at 6000 rpm or more) and grades B1 and B2 (minimum Cetane number of 35 for B1, none specified for B2) are suitable for low speed marine engines (e.g. normal operating range 2000–3000 rpm). The present invention permits the production of diesel fuel for high speed engines from coal extract for, it is believed, the first time. It will be understood, however, that the quality of product can be within quite broad limits and depends largely upon the extent of hydrogenation. The extent of hydrogenation can be varied by adjusting reaction conditions, for example by changing the temperature, pressure or throughput.

The fuel oil produced according to the present invention may, if desired, be blended with petroleum gas oils. Such blending can give a Diesel fuel oil improved in such characteristics as cloud point compared with conventional petroleum gas oil.

Fuel oil manufactured according to the invention has been used to fuel a single cylinder research Diesel engine. The middle oil starting material for the present invention was also tried in the research engine but gave very poor results despite having a substantially identical boiling range to that of gas oil. The middle oil had poor ignition qualities and had to be blended with petroleum gas oil to run the engine. The fuel oil according to the invention on the other hand gave satisfactory performance of the engine generally competitive with that of petroleum gas oil, and appears to offer the possibility, especially after optimisation of engine design, of lower pollution.

The invention, therefore, also provides a method of fuelling a Diesel engine comprising the use of a fuel oil according to the invention.

The invention may be more fully appreciated by reference to the accompanying schematic flow diagram, illustrating a process according to the invention and including the production of coal oil by liquid extraction of coal using as a solvent a recycle oil produced in the process. As the individual unit processes present no difficulty to the skilled man, these are not described in detail but are in accordance with the foregoing description.

Raw coal is fed to the process as stream A and admixed with solvent oil in an approximately 1:3 ratio; the solvent oil being stream G which is the +300° C. fraction from distillation column/separator 3. The oil-coal mixture is digested by heating in a digester generally indicated by 1. $C_1$–$C_4$ gases formed during digestion are taken off as stream B, and residues containing ash and undissolved coal are filtered off and removed as stream C. The filtrate coal oil, stream D, is passed to a catalytic hydrocracker 2, which is supplied with make-up hydrogen E in addition to recycled process hydrogen. The product from the hydrocracker is fed to distillation column/separator 3. From separator 3, light gases, especially $C_1$–$C_5$ gases, are taken off as stream F, −180° C. liquids, largely containing mononuclear aromatics, are removed as stream I, the desired feedstock which is the 180°–300° C. cut is taken off as stream H, and the +300° C. fraction is recycled, as has been stated, as stream G.

Stream H is passed into a catalytic hydrotreater vessel 4 together with hydrogen (E). The hydrogenated product passes to a distillation column/separator 5 in which it is separated into a light fraction (−180° C.) which is added to stream I, and a 180°–300° C. fraction J, which is the desired coal-derived gas oil.

The invention will now be described by way of the following non-limiting example.

EXAMPLE

A coal extract oil was hydrocracked in a small scale continuous catalytic hydrocracker and the crude product was fractionated to give a fraction boiling in the range 170° to 250° C. A sample identified as A was taken from this fraction. Other samples of the fraction were hydrogenated over a sulphided commercial cobalt molybdenum on alumina catalyst at 435° C. and a liquid hourly space velocity of 0.5 $h^{-1}$–1.0 $h^{-1}$. The hydrogenated products were again fractionated to give a fraction boiling in the range 170° to 250° C. and a sample identified as B was taken from this fraction. The composition of the samples A and B, as determined by mass spectrographic analysis, are given in Table 1 below.

TABLE 1

Composition of Coal Derived Oils

| Sample | A | B |
|---|---|---|
| Boiling Range | 170–250° C. | 170–250° C. |
| Substituted decalins and dicyclohexyl | 28.5 | 95.5 |
| Mono cyclo-olefins and alkyl benzenes | 0.1 | 2.3 |
| Substituted tetralins and cyclohexyl benzene | 47.9 | 2.1 |
| Dihydronaphthalenes | 7.7 | 0.1 |
| Naphthalenes | 10.7 | 0.1 |
| Diphenyl and acenaphthene | 3.3 | 0.1 |
| Straight and branched chain paraffins | none | none |

TABLE 1-continued

| Sample | Composition of Coal Derived Oils A | B |
|---|---|---|
| | detected | detected |

The samples A and B were used by an independent firm of consulting engineers to fuel a single cylinder research compression ignition engine of 1.93 l swept volume, having a classic toroidal bowl combustion system in combination with a helical swirl-producing intake port. The compression ratio was 16.0:1.

After thoroughly warming the engine by running for one hour using conventional petroleum gas oil Diesel fuel, the fuel system was drained and replenished with the coal oil sample to be tested. In the case of sample A, attempts to fire the engine proved fruitless and it was concluded that the cetane number or ignition quality of the fuel was too low for the engine even at low speeds. In order to enable testing to continue, it was decided to blend the coal oil sample A with petroleum gas oil, initially in a 2:1 by volume ratio, and then after it was found that this fuel fired easily, all tests were carried out on a 3:1 coal oil to gas oil blend. With the coal oil/gas oil blend fuel consumption values were 10% higher in the mid load range. The engine ran satisfactorily at 20 and 25 rev/sec, but delay periods at higher speeds were unacceptably high and very high rates of pressure rise were encountered. At 30 rev/sec combustion was very harsh and the piston seized; further attempts at high speed running were abandoned. By extrapolation from the ignition qualities of the blend with the gas oil, which has a cetane number of 52, it was calculated that the coal oil sample A had a cetane number of 20.

For sample B, the cetane number was established to be approximately 40. The engine ran well and performance levels were extremely competitive with that achieved with gas oil. A small fuel economy penalty of approximately 2% occurred at mid to high load conditions, but no other significant brake performance differences were noted. The fuel had a similar energy value per gallon to petroleum gas oil; sample B was considered to be competitive with current Diesel fuels on a miles per gallon basis. Although the cetane number of 40 is low in comparison with minimum cetane number for gas oils (50 for UK A-1, 45 for UK A-2, 48 for USA 1-D and 42 for USA 2-D), it is believed that the sample fuel could be used in any conventional automotive Diesel engine, whether using a direct ignition or pre-chamber combustion system.

Sample B was found to have far less "Heavy ends" than petroleum gas oil, leading to faster rates of burning during the latter stages of combustion, enabling a less advanced start of combustion timing for optimum performance, particularly at higher speeds. It was considered likely that the performance of the current generation Diesel engine could be improved by the matching of injection equipment and combustion systems to run on a fuel similar to sample B. The improvements would be directly atributable to the presence of lower quantities of heavy ends and could manifest themselves in terms of lower smoke and particulate levels or possibly lower NOx emissions.

The product according to the invention, sample B, had a density 4% higher than that of the petroleum gas oil used as a standard in the tests. This is thought to be a result of the presence of cycloparaffins rather than paraffins in the fuel.

Repeating the production of sample B using the same conditions but a more controlled liquid hourly space velocity of 0.5 $h^{-1}$, a gas oil was obtained having a cetane number of 46 and a hydrogen content of 13% by wt, compared to sample B's cetane number of 40 and hydrogen content of 12.5%.

The above-described method of preparation of Diesel fuel according to the invention was repeated, but using a temperature of 390° C. for the hydrogenation and the following different space velocities:

| Space Velocity ($h^{-1}$) | Aniline Pt (°C.) | Calculated H Content (wt %) |
|---|---|---|
| 0.5 | 52 | 13.1 |
| 0.75 | 42 | 12.75 |
| 1.0 | 35 | 12.4 |

Cloud points for the Diesel fuels produced according to the invention are in the region −50° to −70° C., which is substantially different to those of petroleum gas oils or gas oils produced from coal tar (in the region −20° to 0° C.) and this is thought to be a direct result of the presence of cycloparaffins rather than paraffins in the fuel.

What I claim is:

1. A process for the production of Diesel fuel suitable for high speed engines, comprising hydrogenating over a hydrogenation catalyst at a temperature of 350° to 450° C. and a hydrogen pressure of 50 to 750 bars a fraction of a hydrocracked coal extract boiling in the range of 170° to 350° C., which fraction contains at least 90% of polycyclic hydrocarbons, contains a major proportion of naphthenes and does not contain any significant amount of mineral matter or paraffinic material, and fractionating the product hydrogenated oil using cut points within the range of 170° to 350° C. to yield a gas oil.

2. A process as claimed in claim 1, wherein the hydrogen concentration is in the range of 40 to 97%.

3. The gas oil produced by the process of claim 1.

4. The gas oil as claimed in claim 3 when blended with a petroleum gas oil.

5. A method of fuelling a high speed Diesel engine, comprising supplying to a combustion chamber of a high speed compression ignition engine a gas oil manufactured by hydrogenating over a hydrogenation catalyst at a temperature of 350° to 450° C. and a hydrogen pressure of 50 to 750 bars, a fraction of a hydrocracked coal extract boiling in the range of 170° to 350° C., which fraction contains at least 90% of polycyclic hydrocarbons, contains a major proportion of naphthenes and does not contain any significant amount of mineral matter or paraffinic material, and fractionating the product hydrogenated oil using cut points within the range of 170° to 350° C. to yield a gas oil; supplying air to said combustion chamber in an effective amount relative to the gas oil; and operating the engine in a Diesel cycle.

* * * * *